US006227415B1

(12) United States Patent
Ritsche et al.

(10) Patent No.: US 6,227,415 B1
(45) Date of Patent: May 8, 2001

(54) THRUST PISTON PUMP WITH DOUBLE VALVE ASSEMBLY

(75) Inventors: Stefan Ritsche, Radolfzell; Esther Amann, Radolfzell-Guettingen, both of (DE)

(73) Assignee: Ing. Erich Pfeiffer GmbH, Radolfzell (DE)

( * ) Notice: Subject to any disclaimer, the term of this patent is extended or adjusted under 35 U.S.C. 154(b) by 0 days.

(21) Appl. No.: 09/098,552

(22) Filed: Jun. 17, 1998

(30) Foreign Application Priority Data

Jun. 27, 1997 (DE) ..... 197 27 356

(51) Int. Cl.[7] ..... B67D 5/40

(52) U.S. Cl. ..... 222/321.2; 222/321.4; 222/376

(58) Field of Search ..... 222/321.4, 321.2, 222/376, 402.19

(56) References Cited

U.S. PATENT DOCUMENTS

| | | | |
|---|---|---|---|
| 3,447,551 | 6/1969 | Braun | 137/43 |
| 4,966,313 | 10/1990 | Lina | 222/402.19 |
| 5,346,104 | 9/1994 | Jeong | 222/402.19 |
| 5,615,806 | 4/1997 | Grothoff | 222/153.13 |

FOREIGN PATENT DOCUMENTS

| | | |
|---|---|---|
| 3636509 A1 | 6/1987 | (DE) . |
| 3936468 C2 | 10/1996 | (DE) . |
| 0 201 701 A2 | 11/1986 | (EP) . |
| 0286 925 A2 | 4/1988 | (EP) . |
| 2 318 685 | 2/1977 | (FR) . |
| 2 390 213 | 12/1978 | (FR) . |
| 58-170562 | 7/1983 | (JP) . |
| 58-159861 | 9/1983 | (JP) . |

OTHER PUBLICATIONS

European Search Report dated Sep. 14, 1999.

*Primary Examiner*—Joseph A. Kaufman
(74) *Attorney, Agent, or Firm*—Quarles & Brady LLP

(57) ABSTRACT

An inlet valve (10) of a dispenser (1) or thrust piston pump, for highly reliable and speedy valve function in all vertical or inclined positions of the dispenser (1) includes, nearer to the pump chamber (20), a valve ball (35) operating in response to pressure and, further away from the pump chamber (20), a valve ball (36) subject to the force of gravity. Ball (36) pushes ball (35) out of its seat (33) in the event that it is firmly seated in the seat (33) due to a vacuum in the reservoir (9) when the dispenser (1) is turned upside down. The seats (33, 34) for the two valve balls (35, 36) are formed by a radially deformable wall (54), which can be tightly and sealingly supported against balls (35, 36).

27 Claims, 1 Drawing Sheet

THRUST PISTON PUMP WITH DOUBLE VALVE ASSEMBLY

TECHNICAL FIELD AND BACKGROUND OF THE INVENTION

The invention relates to a dispenser. Particularly for flowable media which may be gaseous, powdery, pasty and/or liquid. The dispenser is held and operated single-handedly to discharge the medium. The dispenser is intended for use in various positions. For example with the outlet located downwards or upwards. A valve assembly or valve unit is provided. It responds to changes in position of the dispenser by differing valve states.

Such valve units may be an outlet valve, vent valve, mixing valve or the like. The valve unit can control the delivery, pressure or pump chamber. When an inlet valve the volumetrically variable pressure chamber can be filled with medium from a reservoir and through this valve while being expanded or evacuated. The flow direction is then oriented substantially parallel to the pump or valve axis or the like. The valve unit comprises two valves or valve bodies and valve seats following in the flow direction. The upstream valve body is to be translated into its closed position only by gravity. The downstream valve body located nearer to the pressure chamber is translated into its closed position by overpressure in that chamber. An arrangement of valves or valve bodies inverse to the latter is also conceivable.

It may be a disadvantage with such dispensers that the valve responds blocked or delayed when in an end position, for example the closed position. The valve body is thereby pulled into its seat by vacuum or the like so that even higher vacuum at the other side is not instantly sufficient to unseat it. This happens particulary with the first valve which closes as a pop or back valve upon the overpressure in the hauling chamber and should instantly open for filling when this chamber is evacuated. This can also concern the second valve.

OBJECTS OF THE INVENTION

An object is to provide a dispenser which avoids the drawbacks of known configurations or as described. Also a highly reliable valve function should be ensured for a miniaturized dispenser design having components with extremely thin walls.

SUMMARY OF THE INVENTION

In the invention means are provided by which the mass of motion energy of the one valve body is used to lift or push the other valve body out of its stop position, particulary its closed position. The first or second valve seat or valve stop may firstly also be transversely or radially resiliently yieldable. Secondly it may be in contact with the associated valve body when in the stop or closed position. This provides a better centering and more reliable seal. The wall thickness of the first or second valve seat may be less than 1.5 or 0.8 mm and expediently between 0.5 and 0.6 mm. On radial play this wall can easily give way to the contact pressure of the valve body. The seat is able to closely adjust over its full circumference to the shape of the valve elements zone in contact with it. The cited wall thickness is less than the thickness of the wall bounding the hauling chamber at its circumference. The valve wall is contersunk with radial spacing within an outer body.

For the first or second valve body a guide is provided. It is substantially or entirely free of radial motion play over the full valve motion. Thus the valve body can be transferred without transverse motions from one stop position to the other very quickly. The guide is formed by at least three or five circumferentially distributed projections. Longitudinal edge faces thereof extend over the full motion path of the valve body and permanently slidingly engage this body in all of its motions. The medium can flow between the projections through the associated valve chamber from the inlet to the outlet thereof. Flow resistances or flow velocities along the second valve body are thereby less than along the first valve body.

The valve bodies have a specific weight greater than that of the medium. For example by containing a metal, such as steel. For increasing the mass the valve body may consist of metal only in its core. To enhance the cited resilient impact effect on the other valve body the impact face or the outer circumference may also be made of metal. The valve seats or their walls, like all the remaining walls of the dispenser casing or of the piston unit may be made of plastic. The valve bodies could form an assembly unit by being permanently connected to each other directly via a connection. This connector would move commonly with at least one valve body relative to the valve seats. Instead of the valve bodies can be entirely separate balls or the like which are freely movable.

Guide means for the medium flow are provided for protecting at least one valve body against being unseated from its seat by the medium flow counter to its weight force and against coming into contact with the other seat. This specially applies to the second valve body located upstream or farther remote from the hauling chamber. These guide means include a shield covering the valve body over the majority of its base area relative to direct impact of the medium flow directed against it. The guide bypasses this medium flow only into an annular duct about the valve body. The medium flow enters transversely into the valve chamber of this valve body. The flow is directed radially directly against the associated wall and between the projections thereof. Thereby the medium emerges only from a single port. This port covers an arc angle of less than 180° or 90° about the valve axis. The port is bounded integrally over its full circumference, for example by the guide face of the guide means. Also the shield may be integral with the wall of this valve chamber.

A seat or stop for a valve body, as for the first valve body, may be formed by a component separate from all other seats of both valves. This component forms a stop face curved about the valve axis with radial spacing. The component may be a spring, like a helical compression spring. The end winding thereof forms the stop. This spring is a valve closing spring and/or a return spring for the piston unit. Each of the two valve bodies is not spring-loaded toward its closed position or opened position. Instead it is freely movable in each position and controlled only by the conditions of flow, gravity and pressure.

BRIEF DESCRIPTION OF THE DRAWINGS

Example embodiments of the invention are explained in more detail in the following and illustrated in the drawings in which.

DETAILED DESCRIPTION

Figure 1:
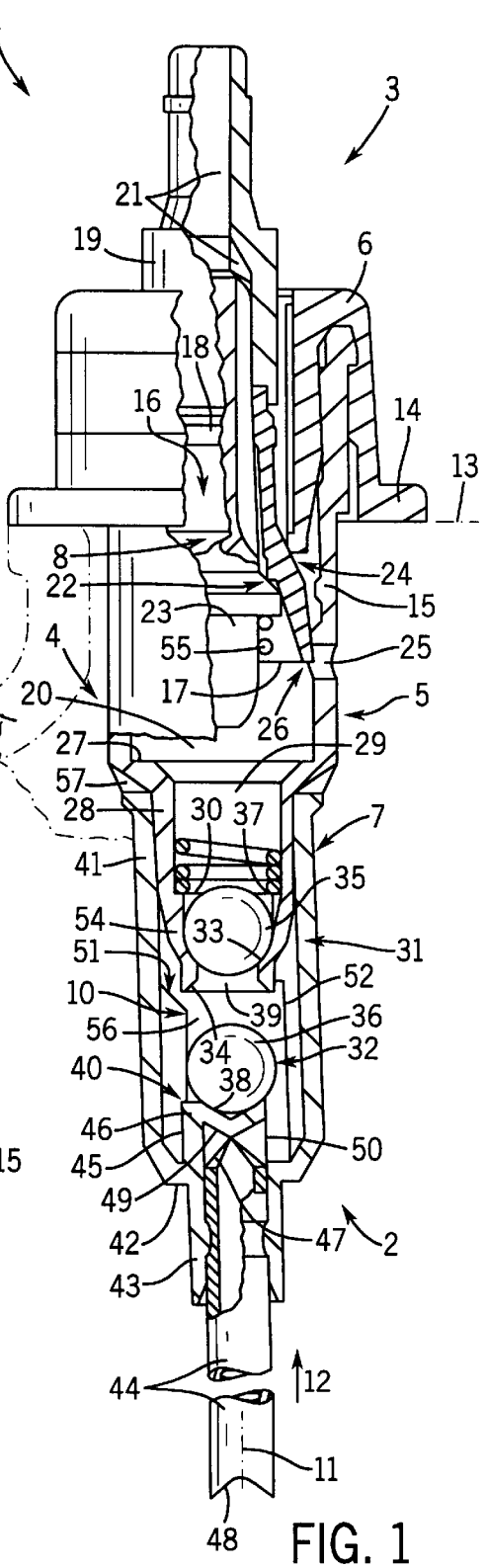
FIG. 1 illustrates the dispenser in accordance with the invention partially in axial section and in the upright normal position.

FIG. 1 illustrates the dispenser 1 upright in the non-actuated initial or rest position. It includes two units 2, 3 movable linearly against each other for actuation. On the working stroke the dispenser 1 is shortened and reelongated on the return stroke. The stationary unit 2 includes a casing 4 of a pump, such as a thrust piston pump. The casing 4 is composed maximally of three body parts 5 to 7 each adjoining the next longitudinally. Unit 3 is slidingly mounted on unit 2. Unit 3 includes a piston unit 8 and a discharge or actuator head (not shown). This head has a handle and a radial medium outlet, like an atomizer nozzle. Unit 2 is to be arranged firmly seated on a reservoir 9 or on the constricted neck of a flask. Casing 4 projects by the majority of its length within reservoir 9. The medium is sucked from reservoir 9 into body 4 via two separate duct paths. For only one of these duct paths a control unit 10 is provided. Unit 10 forms an inlet valve operating in the upright position pressure controlled. In the 180°-inverted position unit 10 operates gravity controlled to close this duct path. All of the cited components 2 to 10 are located in a common axis 11, are substantially dimensionally rigid and are passed by the flow mainly in a single flow direction 12 oriented parallel to axis 11 and directed from unit 10 to unit 8.

Figure 2:
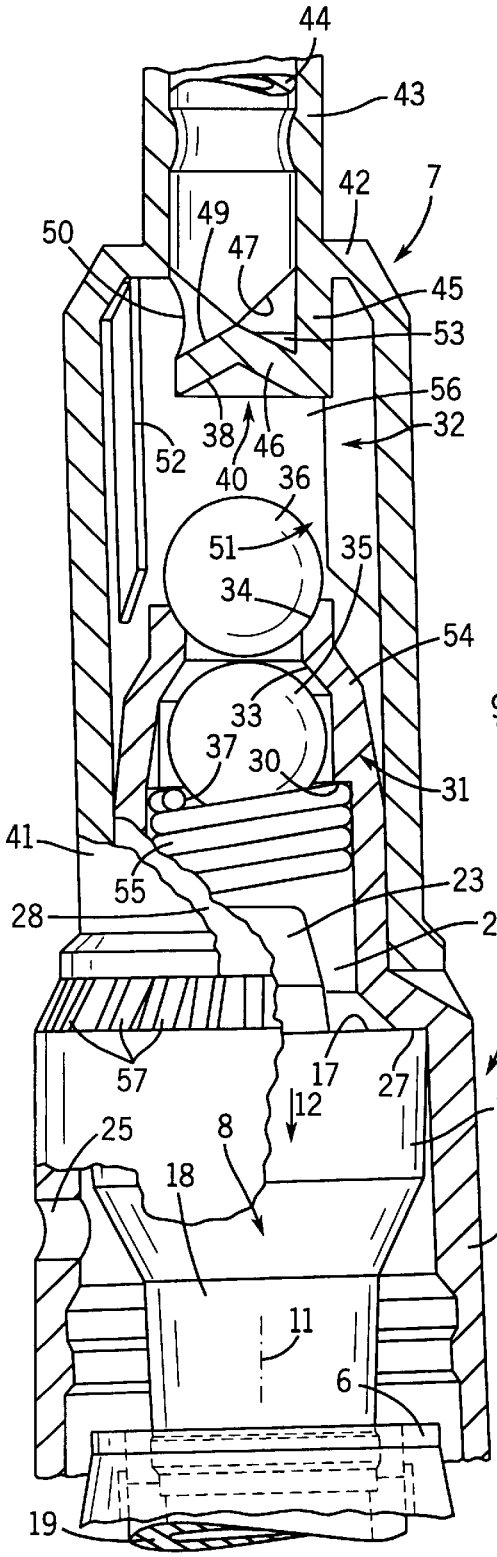
FIG. 2 is an enlarged section of FIG. 1 slightly modified and shown in the inverse upended positioning as well as in actuated end state.

With its end located outside reservoir 9 median body part 5 connects undetachably to body part 6 by a snap connection. Part 6 is located totally outside reservoir 9. Part 6 surrounds the associated end of the shell of part 5 at the outer and inner circumference in tight contact. At the upstream end part 6 comprises a flange 14 protruding radially outwards with an annular support face. In a fixing plane 13 this face is sealingly tensioned against the end face of reservoir neck by a screw cap, a scrimp ring or the like. Plane 13 extends at right angles transverse to axis 11. On the inner circumference of shell 15 of part 5 an elastic piston 16 is slidingly and sealingly guided by lip 17 forming the upstream end of piston 16. The downstream piston end is a constricted sleeve-type stem. The stem end section remote from lip 17 is fixedly connected to a dimensionally rigid actuator 19 by plug-insertion. In FIGS. 1 and 2 stem 18 and actuator 19 permanently traverse a central passage bounded by the annular casing cover. Stem 18 is located permanently totally within casing 4. Actuator 19 permanently protrudes out of casing 4, 6. The downstream constricted end of actuator 19 serves to plug on or insert and fixedly hold the actuator head. This heads medium outlet leads away from the dispenser 1 into the open and communicates to the interior of casing 4.

This duct connection exists with a volumetrically variable pressure chamber 20. Chamber 20 extends from unit 10 up to an outlet valve 22. Chamber 20 is bounded only by part 5, lip 17 and a core body 23 of unit 3. Downstream an outlet duct 21 totally traversing the interior of unit 3 adjoins valve 22. From the seat of valve 22 up to the downstream end of pin-shaped body 23 duct 21 is bounded by the outer circumference body 23. Adjoining thereto duct 21 is bounded only by the inner circumference of actuator 19. In the vicinity of body 23 duct 21 is bounded by the inner circumference of plunger 16. The inner circumference of piston 16 also forms the movable valve body of valve 22. The conical valve seat of valve 22 is the outer circumference of a collar of body 23. Body 23 traverses stem 18 by a slimmer stem and fixedly engages an inner circumference of actuator 19. Stem 18 forms an elastically compressible or shortenable valve spring of valve 22. Stem 18 is integral with lip 17. By shifting unit 3, 8 counter to direction 12 pump chamber 20 is constricted whereas being enlarged in the opposite direction.

For the annular casing space located outside of chamber 20 or downstream of lip 17 a further valve 24 is provided. When opened valve 24 connects this casing space to the passage in cover 6 and thus to the outer atmosphere. Valve 24 serves to vent the reservoir space of reservoir 9 through the interior of casing 4 and is tightly closed in the rest position. Its valve element is formed by a conical outer circumference of piston 16. The valve seat is formed by the end of cover 6 protruding into part 5. On starting actuation of unit 3 counter to direction 12 valve 24 opens. It recloses only when attaining the rest position.

Within the reservoir space or reservoir neck shell 15 is traversed by a radial duct or an opening 25. In the rest position port 25 issues into chamber 20. On start of the working stroke port 25 is constricted and instantly closed. For this purpose a valve 26, namely a gate or slide valve, is provided. The valve body thereof is formed by lip 17. In rest position lip 17 covers only part of port 25. On a first, extremely small partial stroke lip 17 passes port 25. Then port 25 issues only into the casing space adjoining upstream to chamber 20. Thus, with valve 24 open, venting or pressure compensation is permitted exclusively via port 25 both in the normal and in the inverted position. In the inverted or upside-down position port 25 forms the second of the cited duct paths for filling chamber 20 and valve 26 forms the associated inlet valve. Thus chamber 20 is then filled only at the end of the return stroke of unit 3 with unit 10 bypassed. On operation in the normal or upright position, filling chamber 20 occurs exclusively via unit 10 on start of the return stroke and up to opening of valve 26 with port 25 bypassed.

The end position of the working stroke or initial position of the return stroke is defined by a stop 27 located within casing 4. Stop 27 is an annular shoulder of part 5. The counterstop is lip 17. If after abutting unit 3 is moved further counter to direction 12 valve 22 opens. Valve body 23 is thereby moved with ram 19 relative to lip 17 and the valve body of piston 16 while stem 18 is shortened. Valve 22 may also be opened prior to this stopping action when exposed to a correspondingly high overpressure in chamber 20.

In the vicinity of inner shoulder 27 the widened length section of shell 15 adjoins counter to direction 12 a slimmer lug 28. Lug 28 is longer than chamber 20 and located totally within part 7. Part 7, like parts 5, 6, 28 is full-length hollow or a shell body. Part 7 is fixedly plug-mounted on part 5 counter to the insertion direction of cover 6, namely in direction 12. Part 7 is located totally upstream of shoulder 27. Lug 28 bounds in its interior a more constricted section 29 of chamber 20. Section 29 adjoins shoulder 27 and is slimmer than the running face for lip 17. Within part 7 and inside lug 28 an abutment 30 is provided for the upstream end of a spring 55. Spring 55 is located totally within chamber 20. It is a return spring for unit 3 and for valve body 23. Support 30 is an annular shoulder of the inner circumference of lug 28. Face 30 is located in the vicinity of unit 10.

Unit 10 comprises a first valve 31 directly adjoining chamber 20 and a second valve 32 located upstream of valve 31 or further away from chamber 20. Valve 31 includes as a first valve element a first valve seat 33 and a first valve ball 35. Valve 32 includes a second valve seat 34 with a second valve ball 36 for mutual contact in the closed position. For contacting ball 35 or 36 in the open position in each case a stop or seat 37 or 38 is provided. In both stop positions and in all intermediate positions balls 35, 36 are coaxial with axis 11. The opposingly and acutely conically widened valve seats 33, 34 bound a medium passage 39. Duct 39 is located in axis 11 and free of any recesses or grooves. Between seats 33, 34 duct 39 includes a most narrow length section substantially shorter than its diameter or radius and also shorter than the diameter or radius of balls 35, 36. Both seats 33, 34 are integral with shells 15, 28 and are located near to each other. Thus when one ball is in contact with its seat the other ball abuts against this ball before reaching its seat. Thus the other ball is able to sealingly close passage 39.

On the side of valve 32 remote from valve 31 a shield 40 is provided for ball 36. Shield 40 bypasses the medium flow supplied in direction 12 outwardly around ball 36. Thus in the upright position this flow is prevented from unseating ball 36 off its rest seat 38 and from translating ball 36 to seat 34 or to the closed position. Shell 41 of part 7 closely adjoins the outer circumference of lug 28. Thereby shells 28, 41 are mutually reinforced. At its upstream end shell 41 passes over to an annular end wall 42. An annular reception 43 for a flexible riser tube 44 connects to wall 42 in and opposite direction 12. Suction tube 44 is inserted into mount 43 up to shield 40 in direction 12. Tube 44 extends beyond wall 42 in direction 12. Tube 44 serves to suck medium from the bottom portion of reservoir 9 remote from the neck when the dispenser 1 is used in the upright position.

Shell 43 is slimmer than the inner circumference of shell 41 and forms a tubular lug 45. Lug 45 freely protrudes in direction 12 beyond wall 42 into shell 41. Lug 45 bounds with shell 41 an annular space. At the inner end lug 45 passes over to an end or transverse wall 46 of shield 40. At its two remote faces or as a whole wall 46 in axial cross-section is conically pointed at an obtuse angle. The outer wall side thus forms the conically recessed seat 38. The inner wall face protrudes as pointed cone opposite direction 12 and forms a guide face 49 for the medium flowing towards unit 10. Wall 46 has a constant wall thickness all over and is located like support section 45 with no contact within shell 41. Walls 41, 42, 43, 45 are integral with each other.

Both ends of duct 44 possibly also integral with the cited walls, are equally shaped. Each end has an uneven end face 47, 48. As viewed radially face 47, 48 is a single obtusely angeled V-shaped recess. The recess flanks extend up to the outer circumference and interconnect therebetween concavely rounded. One end 47 comes into contact with face 49. Thus its recess extends maximally up to the inner side of wall 42. The other end 48 is located in the bottom portion of reservoir 9. A transfer port 50 adjoins the inner side of wall 42 and face 49. Outlet 50 for the medium passes radially through wall 45. Port 50 is continuously widened in direction 12 by inclined face 49. The boundary edge surrounding port 50 may be entirely located in a plane parallel to axis 10. Thus walls 45, 46, in axial view, have the form of an annular or circle section with an arc angle exceeding 200° or 250°.

The sole medium exit 50 is oriented radially or inclined slightly in direction 12 towards the inner circumference of wall 41. Thus the liquid filling the annular space about lug 45 is deflected at wall 41 in direction 12 and flows along ball 36 in reaching passage 39. Thereby ball 36 is not unseated from seat 38. The spherical curved surface of ball 36 is in contact with passage 39 merely by a circle significantly smaller than the ball diameter. The contact circles diameter is only roughly half the ball diameter and coaxial with axis 11. Thus ball 36 cannot jam in seat 38 in the rest position as could occur in a deeper cup reception. With valves 31, 32 open the annular flow cross-sections bounded by body 35 are always significantly smaller than the annular flow cross-sections bounded by body 36.

Relative to casing 4 each ball 35, 36 is precisely centered over its full motion path oriented parallel to axis 11 by separate guides. Ball 36 has guide 51. For this purpose six projections 52 or axial ribs are evenly distributed about the inner circumference of wall 41. Ribs 52 are integrally adjoining walls 41, 42, 45, 46 and guide ball 36 by their longitudinal edge faces opposing axis 11. Lugs 52 thus stiffen also walls 41 to 43 and 45, 46 relative to each other. Between lugs 52 ducts are free to prevent rotational flows about ball 36. Thus ball 36 is prevented from being entrained in the flow. Lugs 52 extend substantially up to nearest seat 34. A corresponding guide for ball 35 extends from the downstrean end of seat 33 up to seat 37. Here the lugs protrude less. A rib 53 diametrically opposes port 50. This rib mutually stiffens walls 45, 46, directly connects to face 49 and also prevents rotational or vortex flows.

The outer and inner circumference of the upstream end section 54 of lug 28 is constricted counter direction 12 not before the abutment 30. Thus section 54 is without contact from its free end and in direction 12 beyond seats 30, 33, 37 relative to the inner circumferences of wall 41 and guide 51. Counter to direction 12 shell wall 54 including seat 33 become thinner. Then wall 54 becomes slightly thicker and then in the vicinity of seat 34 again thinner. Thus wall 54 reversibly and resiliently deforms in response to the contact pressure of ball 35 or 36. Wall 54 can therefore sealingly support against bail 35, 36 without this being prevented by abutting against part 7. The median spacing between seats 33, 34 facing away from each other is smaller than half or a third of the ball diameter. This diameter is smaller than 5 mm and larger than 2 mm. The spacing between seats 37, 38 facing each other is maximally four or three times as large as the ball diameter. Thus very short control pathes of valves 31, 32 are given. The control path of ball 35 is, however, significantly smaller than that of ball 36. The largest center-spacing between balls 35, 36 is smaller than three times or twice their diameter. Both balls are equal or equal in size. Thus they are interchangeable. Return spring 55 forms by its end winding seat 37. With its other downstream end spring 55 supports on 23 permanently axially pretensioned as spring 55 does on face 30.

In upright position flow 12 is directed upwards since reservoir 9 is located below the actuator head. On manual actuation counter to direction 12 valves 26, 31 are first closed by the thrust motion or overpressure in chamber 20. Thereafter the medium in chamber 20 is compressed. Then after opening of valve 22 this medium is discharged via duct 21 into the actuator head and through the nozzle thereof into the environment. During the complete forward stroke atmospheric air can be sucked into reservoir 9 via valve 24 and port 25. On start of the return stroke valve 22 closes. Thus subsequently chamber 20 is evacuated. Thereby valve 31 opens. Medium is therefore sucked in sequence through tube 44, port 50, valve chamber 56, passage 39 and seat 37 into chamber 20. The chamber permanently accommodating ball 36 has a larger width than that of the chamber permanently accomodating ball 35. Thus the different passage cross-sections are achieved. During the complete forward and return stroke ball 36 remains on seat 38. At the end of the return stroke valve 26 is first opened and directly subsequently valve 24 is closed. A further pumping cycle of this kind can then begin.

In the inverted position the actuator head is located below reservoir 9. Thus ball 36 drops by its weight force from seat 38 into seat 34 and ball 35 drops by its weight force from seat 33 into seat 37. Valve 32 is then closed and valve 31 opened. On the forward stroke up to the stroke end position (shown in FIG. 2) body 23 protrudes into chamber 29, valve 31 closes due to the pressure in chamber 20. Thereby ball 35 unseats ball 36 from its seat 34 and only after reaches seat 33. The medium is again discharged in the way as described. Thereby and during the complete forward stroke ball 36 rests under its weight force on ball 35 with which it is in point contact. When the return stroke starts from the position shown in FIG. 2, although valve 31 first opens by ball 35 unseating from seat 33, however, simultaneously and synchroneously ball 36 follows by its weight until engaging seat 34. Only after this primary motion path ball 35 releases from ball 36 which acts as a driver and travels again a second motion path of at the most the same length as the primary path until becoming seated on seat 37. When flow direction 12 is oriented downwards unit 10 is thus closed by valve 32. Thus no medium is able to be sucked into chamber 56 via tube 44. Instead, chamber 20 is evacuated dry until valve 26 opens and medium is sucked directly through shell 15 into chamber 20 solely via port 25 at a higher flow velocity significantly higher than via the valve unit 10. Thus after this the next forward or discharge stroke can start.

Seats 33, 34 can also be mutually opposed. Only a single valve body or ball can be provided between the seats to alternately close only one seat at a time. A further or spherical impinging body could then be provided upstream or downstream of the seats to push the valve ball out of the next or juxtaposed seat. Seat 37 in this case too, would be a valve closing seat. The associated impinging body could be movable in chamber 29 or 56. When the dispenser 1 is inverted from its position shown in FIG. 2 into the position shown in FIG. 1 balls 35, 36 drop back by their weight into seats 33 and 38 respectively. Due to guides 51 valves 31, 32 also operate in any inclined position of the dispenser 1 or of axis 11.

The downstream end of part 7 comprises an annular flange thicker than shell 41 and protruding only beyond its outer circumference. This flange contacts an outer shoulder face of part 5. This shoulder face is formed by the same, annular transition or wall section as face 27. This section extends transverse to axis 11 and connects shells 15, 28. Also it forms at its outer side circumferentially distributed projections or ribs 57. Ribs 57 are mutually spaced and bound intermediate grooves. Thus a highly reliable contact of the end face of shell 41 at the edge faces of ribs 57 is assured. Further a tool can be used to engage between ribs 57 to urge part 7 axially away from part 5 counter to direction 12.

For assembly ball 35 may be first inserted into lug 28 counter to direction 12 and without having to overcome a latching or snap point. Thereafter spring 55 and piston unit 8 as well as, thereafter, cover 6 are inserted in the same direction in their positions ready for operation. Before or after these assembly steps ball 36 is inserted counter to direction 12 into part 7. Thereafter part 7 is slid in direction 12 on and over lug 28. After insertion of the dispenser 1 assembled as above into reservoir 9 all valves 10, 22, 24, 26 as well as chamber 20 and port 25 are located upstream of plane 13. An annular passage for venting the reservoir space is then bounded by the reservoir neck and shell 15. Parts 5 to 7, 19, 35, 36 are dimensionally rigid, except for sleeve 54.

The end section of casing 4 formed in this case by separate cover 6 may also be integral with part 5 which then forms flange 14. It will be appreciated that all features, properties and effects cited may be precisely or merely substantially or roughly so as explained and may also greatly depart therefrom depending on individual requirements.

We claim:

1. A dispenser for discharging media comprising:

a casing (4);

a hauling chamber (20) located in said casing (4) and including a medium passage defining a flow direction (12);

valve means (10) for controlling said medium passage and including two valves (31, 32), namely a first valve (31) and a second valve (32) located upstream of said first valve (31);

in operation said dispenser (1) defining an upright position and an inverted position with said flow direction (12) being downwardly directed in said inverted position said second valve (32) being positioned by influence of gravity for barring said medium passage;

said valve means (10) including at least one valve seat (33, 34) and first and second valve bodies (35, 36), and a driver, said driver operationally substantially directly displacing said first valve body (35), said second valve body (36) including said driver, said first valve body (35) being displaceable relative to said second valve body (36) and said casing (4).

2. The dispenser according to claim 1, wherein a displacing guide (51) is included for displacingly guiding at least one of said first and second valve bodies (35, 36) without radial motion play, said displacing guide connecting to said at least one valve seat (33, 34).

3. The dispenser according to claim 1, wherein at least one of said first and second valve bodies (35, 36) is permanently centered with respect to said at least one valve seat (33, 35) without radial motion play.

4. The dispenser according to claim 1, wherein said at least one valve seat includes a first valve seat (33) and a second valve seat (34) facing away from said first valve seat (33), said first and second valve seats (33, 34) being traversed by a valve passage (39), said first and second valve seats (33, 34) being commonly in one part.

5. The dispenser according to claim 4, wherein a valve jacket (54) is included and sealingly connects said first valve seat (33) with said second valve seat (34), said valve jacket (54) being sealingly closed with respect to said hauling chamber (20) when said first valve (31) is closed and when said second valve (32) is closed, said valve jacket (54) having an exterior portion that is constricted towards at least one of said first and second valve seats (33, 34), said valve jacket (54) being in one part.

6. The dispenser according to claim 1 and further defining a first shut state when said first valve (31) is closed and a second shut state when said second valve (32) is closed, wherein in said first shut state said first valve body (35) directly mechanically prevents said second valve body (36) to transfer to said second shut state, in said second shut state said second valve body (36) mechanically preventing said first valve body (35) from being transferred to said first shut state.

7. The dispenser according to claim 1, wherein at least one of said first and second valve bodies (35, 36) includes a spherical surface, said driver directly contacting said first valve body (35) and including a spherical surface.

8. The dispenser according to claim 1, wherein said first and second valve bodies are separate bodies mutually operationally entirely disengaging and including first and second impact faces, said first impact face of said first valve body (35) operationally engaging said second impact face of said second valve body (36) to displace said second valve body (36) and open said second valve (32), said second impact face of said second valve body (36) operationally engaging said first impact face to displace said first valve body (35) and open said first valve (31).

9. The dispenser according to claim 1, wherein at least one of said first and second valve bodies (35, 36) includes a metallic component.

10. The dispenser according to claim 1 and further including a contact face (38) for resting at least one of said first and second valve bodies (35, 36) when retracted from said at least one valve seat (33, 34), wherein in axial cross-section said contact face (38) is substantially V-shaped.

11. The dispenser according to claim 1, wherein said hauling chamber (20) is volumetrically variable.

12. The dispenser according to claim 1, wherein said hauling chamber (20) is coaxial with said at least one valve seat (33, 34).

13. A dispenser for discharging media comprising:

a casing (4);

a hauling chamber (20) located in said casing (4) and including a medium passage defining a flow direction (12);

valve means (10) for controlling said medium passage and including two valves (31, 32), namely a first valve (31) and a second valve (32) located upstream of said first valve (31);

in operation said dispenser (1) defining an upright position and an inverted position with said flow direction (12) being downwardly directed, in said inverted position said second valve (32) blocking flow through said medium passage;

said valve means (10) including at least one valve seat (33, 34) and first and second valve bodies (35, 36); and a driver, said driver operationally substantially directly displacing said first valve body (35), said second valve body (36) including said driver, said first valve body (35) being displaceable relative to said second valve body (36) and said casing (4);

a valve chamber (56) housing at least said second valve body (36) and having a port (50) which is partly radially directed;

wherein a displacing guide (51) is included for displacingly guiding said second valve body (35) without radial motion play, said displacing guide connecting to said at least one valve seat (33, 34); and wherein said displacing guide (51) is located in said valve chamber (56) and includes circumferentially distributed projections (52) directly engaging said second valve body 35 such that rotational flows are prevented in said valve chamber.

14. A dispenser for discharging media comprising:

a casing (4);

a hauling chamber (20) located in said casing (4) and including a medium passage defining a flow direction (12);

valve means (10) for controlling said medium passage and including two valves (31, 32), namely a first valve (31) and a second valve (32) located upstream of said first valve (31);

in operation said dispenser (1) defining an upright position and an inverted position with said flow direction (12) being downwardly directed, in said inverted position said second valve (32) barring said medium passage;

said valve means (10) including at least one valve seat (33, 34) and first and second valve bodies (35, 36); and a driver, said driver operationally substantially directly displacing said first valve body (35), said second valve body (36) including said driver, said first valve body (35) being displaceable relative to said second valve body (36) and said casing (4), said dispenser further defining a specific body gravity of said first and second valve bodies (35, 36) and a specific medium gravity of the media, wherein said body gravity of at least one of said first and second valve bodies (35, 36) is higher than the medium gravity, thereby at least one of said first and second valve bodies (35, 36) providing a suspending sinking body when immersed in the media.

15. A dispenser for discharging media comprising:

a casing (4);

a hauling chamber (20) located in said casing (4) and including a medium passage defining a flow direction (12);

valve means (10) for controlling said medium passage and including two valves (31, 32), namely a first valve (31) and a second valve (32) located upstream of said first valve (31);

in operation said dispenser (1) defining an upright position and an inverted position with said flow direction (12) being downwardly directed, in said inverted position said second valve (32) barring said medium passage;

said valve means (10) including at least one valve seat (33, 34) and first and second valve bodies (35, 36); and a driver, said driver operationally substantially directly displacing said first valve body (35), said second valve body (36) including said driver, said first valve body (35) being displaceable relative to said second valve body (36) and said casing (4); and said dispenser further defining a medium flow passing said medium passage, wherein a shield 40 is included for shielding said second valve body (36) against the medium flow.

16. The dispenser according to claim 15, wherein said casing (4) includes a casing jacket (41) defining a length, section of said casing (4), said shield (40) being in one part with said casing jacket, said second valve body (36) defining a center located permanently downstream of said shield (40).

17. The dispenser according to claim 15 and further including a valve chamber (56) and a projection (45) freely projecting into said valve chamber (56), wherein said projection (45) includes a projection end and said shield (40).

18. The dispenser according to claim 15 and further including a projection (45) projecting toward at least one of said first and second valve bodies (35, 36), wherein said casing (4) includes an end wall (42) defining an inside, said projection (45) projecting away from said inside and being radially spaced from an inner circumference of said casing (4).

19. A dispenser for discharging media comprising:

a casing (4);

a hauling chamber (20) located in said casing (4) and including a medium passage defining a flow direction (12);

valve means (10) for controlling said medium passage and including two valves (31, 32), namely a first valve (31) and a second valve (32) located upstream of said first valve (31);

in operation said dispenser (1) defining an upright position and an inverted position with said flow direction

(12) being downwardly directed, in said inverted position said second valve (32) barring said medium passage;

said valve means (10) including at least one valve seat (33, 34) and first and second valve bodies (35, 36); and a driver, said driver operationally substantially directly displacing said first valve body (35), said second valve body (36) including said driver, said first valve body (35) being displaceable relative to said second valve body (36) and said casing (4); and said dispenser further including a transverse duct (25) traversing said casing (4) and connecting to said hauling chamber (20) downstream of said valve means (10), wherein a slide valve (26) is included for widening and constricting said transverse duct (25), said transverse duct (25) being provided for at least one of filling said hauling chamber with the media, and venting a zone (9) outside said casing (4).

20. A dispenser for discharging media comprising:

a casing (4);

a hauling chamber (20) located in said casing (4) and including a medium passage defining a flow direction (12);

valve means (10) for controlling said medium passage and including two valves (31, 32), namely a first valve (31) and a second valve (32) located upstream of said first valve (31);

in operation said dispenser (1) defining an upright position and an inverted position with said flow direction (12) being downwardly directed, in said inverted position said second valve (32) barring said medium passage;

said valve means (10) including at least one valve seat (33, 34) and first and second valve bodies (35, 36); and a driver, said driver operationally substantially directly displacing said first valve body (35), said second valve body (36) including said driver, said first valve body (35) being displaceable relative to said second valve body (36) and said casing (4); and wherein said casing (4) includes first and second casing shells (15, 41) axially interconnected, said first casing shell (15) including said at least one valve seat (33, 34) and said second casing shell (41) including an abutting face (38) for abutting at least one of said first and second valve bodies (35, 36).

21. A dispenser for discharging media comprising:

a casing (4);

a hauling chamber (20) located in said casing (4) and including a medium passage defining a flow direction (12);

valve means (10) for controlling said medium passage and including two valves (31, 32), namely a first valve (31) and a second valve (32) located upstream of said first valve (31);

in operation said dispenser (1) defining an upright position and an inverted position with said flow direction (12) being downwardly directed, in said inverted position said second valve (32) barring said medium passage;

said valve means (10) including at least one valve seat (33, 34) and first and second valve bodies (35, 36), and a driver, said driver operationally substantially directly displacing said first valve body (35), said second valve body (36) including said driver, said first valve body (35) being displaceable relative to said second valve body (36) and said casing (4);

and further including opposing first and second abutting faces (37, 38) for abutting said first and second valve bodies (35, 36), wherein said at least one valve seat (33, 34) is located between said first and second abutting faces (37, 38), said at least one valve seat (33, 34) being in one part with said second abutting face (38).

22. A dispenser for discharging media comprising:

a casing (4);

valve means (10) for controlling flow of the medium and including at least one valve (31, 32), said valve means (10) including at least one valve seat (33, 34) and at least one valve body (35, 36); and a shield (40), said shield shielding said at least one valve body (36) against the flow of the medium.

23. A dispenser for discharging media comprising:

a casing (4);

valve means (10) for controlling flow of the medium and including at least one valve (31, 32), said valve means (10) including at least one valve seat (33, 34) and at least one valve body (35, 36); and a guide face (49), said guide face (49) guiding the medium and being pointed counter to a flow direction (12) of the flow of the medium, when viewed parallel to said flow direction (12) said guide face (49) at least partly covering said at last one valve body (35, 36).

24. A dispenser for discharging media comprising:

a casing (4);

valve means (10) for controlling flow of the medium and including at least one valve (31, 32), said valve means (10) including at last one valve seat (33, 34) and at least one valve body (35, 36); and a transition port (50), said transition port (50) guiding the medium into said valve means (10) and being oriented transverse to a flow direction (12) of the flow of the medium, said transition port (50) traversing said casing (4).

25. A dispenser for discharging media comprising:

a casing (4);

valve means (10) for controlling flow of the medium and including at least one valve (31, 32), said valve means (10) including at least one valve seat (33, 34) and at least one valve body (35, 36); and first and second casing shells (15, 41), said casing (4) including said first and second casing shells (15, 41) which are axially interconnected, said first casing shell (15) including said at least one valve seat (33, 34) and said second casing shell (41) including an abutting face (38) for abutting said at least one valve body (35, 36).

26. A dispenser for discharging media comprising:

a casing (4);

a hauling chamber (20) located in said casing (4) and including a medium passage defining a flow direction (12);

valve means (10) for controlling said medium passage and including two valves (31, 32), namely a first valve (31) and a second valve (32) located upstream of said first valve (31);

in operation said dispenser (1) defining an upright position and an inverted position with said flow direction (12) being downwardly directed, in said inverted position said second valve (32) barring said medium passage;

said valve means (10) including at least one valve seat (33, 34) and first and second valve bodies (35, 36); and a driver, said driver operationally substantially directly displacing said first valve body (35), said second valve body (36) including said driver, said first valve body (35) being displaceable relative to said second valve body (36) and said casing (4), and said dispenser further including a guide face (49) for guiding the medium, wherein said guide face (49) is pointed counter to said flow direction (12), when viewed parallel to said flow direction (12) said guide face (49) at least partly covering at least one of said first and second valve bodies (35, 36).

27. A dispenser for discharging media comprising:

a casing (4);

a hauling chamber (20) located in said casing (4) and including a medium passage defining a flow direction (12);

valve means (10) for controlling said medium passage and including two valves (31, 32), namely a first valve (31) and a second valve (32) located upstream of said first valve (31);

in operation said dispenser (1) defining an upright position and an inverted position with said flow direction (12) being downwardly directed, in said inverted position said second valve (32) barring said medium passage;

said valve means (10) including at least one valve seat (33, 34) and first and second valve bodies (35, 36); and a driver, said driver operationally substantially directly displacing said first valve body (35), said second valve body (36) including said driver, said first valve body (35) being displaceable relative to said second valve body (36) and said casing (4); and said dispenser further including a transition port (50) for guiding the medium into said valve means (10), wherein said transition port (50) is oriented transverse to said flow direction (12), said transition port (50) traversing a tube jacket (45).

* * * * *

UNITED STATES PATENT AND TRADEMARK OFFICE

CERTIFICATE OF CORRECTION

PATENT NO. : 6,227,415 B1
DATED : May 8, 2001
INVENTOR(S) : Stefan Ritsche

It is certified that error appears in the above-identified patent and that said Letters Patent is hereby corrected as shown below:

Column 6,
Line 29, "bail" should be -- ball --.
Line 35, "pathes" should be -- paths --.

Column 8,
Line 11, "and•an" should be -- and a --.
Line 53, "to transfer" should be -- from being transferred --.

Signed and Sealed this

Sixteenth Day of April, 2002

*Attest:*

*Attesting Officer*

JAMES E. ROGAN
*Director of the United States Patent and Trademark Office*